US010465392B2

(12) United States Patent
Marcon

(10) Patent No.: US 10,465,392 B2
(45) Date of Patent: Nov. 5, 2019

(54) UNIVERSAL SCREW-DRIVING MACHINE SUPPORT FOR A PLATE-LIFTING TOOL, TOOL EQUIPPED WITH THIS SUPPORT, AND IMPLEMENTATION METHOD

(71) Applicant: ÉTABLISSEMENTS PIERRE GRÉHAL ET CIE SA, Baillet en France (FR)

(72) Inventor: Lionel Marcon, Parmain (FR)

(73) Assignee: ÉTABLISSEMENTS PIERRE GRÉHAL ET CIE SA, Baillet-en-France (FR)

( * ) Notice: Subject to any disclaimer, the term of this patent is extended or adjusted under 35 U.S.C. 154(b) by 0 days.

(21) Appl. No.: 15/523,689

(22) PCT Filed: Oct. 2, 2015

(86) PCT No.: PCT/FR2015/052662
§ 371 (c)(1),
(2) Date: May 2, 2017

(87) PCT Pub. No.: WO2016/071592
PCT Pub. Date: May 12, 2016

(65) Prior Publication Data

US 2017/0335579 A1 Nov. 23, 2017

(30) Foreign Application Priority Data

Nov. 6, 2014 (FR) ..... 14 60726

(51) Int. Cl.
*E04F 21/18* (2006.01)
*B25H 1/00* (2006.01)

(52) U.S. Cl.
CPC ..... *E04F 21/1811* (2013.01); *B25H 1/0035* (2013.01)

(58) Field of Classification Search
CPC .. E04F 21/1811; B25H 1/0057; B25H 1/0064
(Continued)

(56) References Cited

U.S. PATENT DOCUMENTS 2,856,799 A * 10/1958 De Curtis ..... B25H 1/0042 408/103
4,213,504 A * 7/1980 Schneider ..... A01B 1/065 172/25

(Continued)

FOREIGN PATENT DOCUMENTS

EP 2 314 422 4/2011
EP 2314422 A1 * 4/2011 ..... B25H 1/0035
FR 2 758 150 7/1998

*Primary Examiner* — Lynn E Schwenning
(74) *Attorney, Agent, or Firm* — Clark & Brody

(57) ABSTRACT

A screw-driving machine support for a plate-lifting tool comprises a telescopic mast comprising a fixed segment and a first telescopic segment mounted so as to slide inside the fixed segment and a lifting mechanism using a gear or winch for the first sliding segment relative to the fixed segment. The lifting mechanism comprises a driving shaft with a rotation axis and a reversible fastening means with a shaft for screwing and unscrewing a screw-driving machine, which comprises, in the position of use a member for fastening to the mast, a lateral stop which is vertical, parallel and laterally offset to the axis of rotation of the driving shaft by a given center distance and is designed to lock a screw-driving machine handle laterally in the position of use and a member for adjusting the position of the vertical stop (420) relative to the axis of rotation of the driving shaft.

13 Claims, 1 Drawing Sheet

Figure 1:
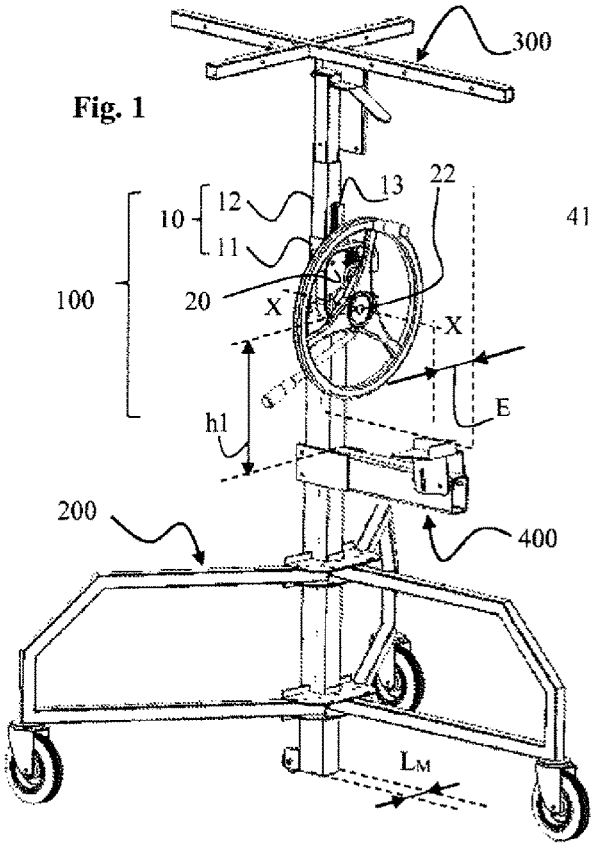

(58) Field of Classification Search
USPC ..... 414/10–12
See application file for complete search history.

(56) References Cited

U.S. PATENT DOCUMENTS

| | | | | | |
|---|---|---|---|---|---|
| 4,314,782 | A * | 2/1982 | Beekenkamp | B25H 1/005 | 408/110 |
| 5,322,397 | A * | 6/1994 | Spear | B25H 1/0035 | 173/36 |
| 6,238,159 | B1 * | 5/2001 | Pappas | A47B 77/00 | 187/244 |
| 6,264,407 | B1 * | 7/2001 | Tinken | B23B 41/006 | 408/136 |
| 7,828,506 | B1 | 11/2010 | Young | | |
| 8,292,039 | B2 * | 10/2012 | Campbell | B66F 17/006 | 182/142 |
| 9,999,969 | B1 * | 6/2018 | Walter | B25F 3/00 | |
| 2004/0231917 | A1 * | 11/2004 | Chick | E04G 1/24 | 182/16 |
| 2006/0070817 | A1 * | 4/2006 | Campbell | B66F 11/04 | 187/238 |
| 2008/0190164 | A1 * | 8/2008 | Boon | B21D 7/063 | 72/217 |
| 2011/0206487 | A1 * | 8/2011 | Morgan | B60B 29/00 | 414/427 |

* cited by examiner

UNIVERSAL SCREW-DRIVING MACHINE SUPPORT FOR A PLATE-LIFTING TOOL, TOOL EQUIPPED WITH THIS SUPPORT, AND IMPLEMENTATION METHOD

The invention concerns a universal screw-driving machine support for a plate-lifting tool, a tool equipped with such a support, and an implementation method.

In particular, the invention concerns lifting and handling apparatus, generally called "plate-lifts", with a winch or gear mechanism, which are used during construction work for manipulating and positioning heavy objects, such as material plates (plasterboard, wood panels, etc.), in order to produce suspended ceilings or ceilings on sloping walls or partitions.

The general structure of a plate-lift is as follows: a telescopic mast which can be controlled by a lifting mechanism with a winch or gear mechanism is mounted on a rolling base. A plate support is mounted pivotably at the end of the mast via a pivot mechanism.

The telescopic mast comprises a first fixed element and at least one telescopic element which is movable relative to the fixed element. In general, the mast comprises two telescopic movable elements.

Known plate-lifts include the models already described for example in document FR2758150 and comprise, with reference to the usage position:

- a telescopic mast comprising a fixed segment and a first telescopic segment mounted so as to slide inside the fixed segment;
- a set of cables and pulleys forming a rope drive;
- a cable traction winch comprising a driving shaft in engagement with a crank handle.

This type of plate-lift does not allow activation of the winch by a screw-driving machine. It is therefore exclusively manual and slow.

To solve this problem, the model "ELAND®" sold by the company Flex comprises, with reference to the usage position:

- a telescopic mast comprising a fixed segment and a first telescopic segment mounted so as to slide inside the fixed segment;
- a set of cables and pulleys forming a rope drive;
- a cable traction winch comprising a driving shaft in engagement with a screw-driving machine.

To prevent the user from suffering a twisting of the wrist when attempting to use the screw-driving machine, the screw-driving machine is itself fixed to the mast of the plate-lift.

The screw-driving machine merely acts as a simple motorized mechanism, the use of a screw-driving machine serving merely to limit the design costs of a battery-powered motor. It is not therefore possible to use a screw-driving machine as found on a construction site. In addition to the very high cost of such a plate-lift, the constant presence of the screw-driving machine can render the tool bulky and heavy to handle.

In addition to plate-lifts with winches, the Applicant has developed a plate-lift equipped with a geared lifting mechanism. This type of device is particularly interesting since it is quiet and requires less force for lifting the plates.

Such a plate-lift is illustrated in FIG. 1.

The device therefore comprises, with reference to the usage position:

- a telescopic mast comprising a fixed segment and a first telescopic segment mounted so as to slide inside the fixed segment;

- a rack of specific width, furnished with teeth and fixed along the first telescopic segment;
- a gear system comprising:
  - a pinion in direct engagement with the rack;
  - a driving shaft in engagement with the pinion and preferably fixed to a manual control wheel.

According to an advantageous embodiment, the driving shaft has an end equipped with an end piece for fixing a portable electric screw-driving machine. It is thus possible to actuate the lifting mechanism by a screw-driving machine, which limits the forces required.

Screw-driving machines are very commonly used on construction sites and very easy to recharge.

Nonetheless, when the plate support is loaded, it is possible for the user to suffer a twisting of the wrist when attempting to use the screw-driving machine. In fact, he must hold the screw-driving machine very firmly in position, such that the torque of the screw-driving machine is transmitted to the gear mechanism and not to the user's arm.

The present invention therefore proposes a universal screw-driving machine support, i.e. allowing the use of different models of screw-driving machines currently available commercially, allowing safe actuation of the lifting mechanism with no risk of injury for the user.

Screw-driving machines have the general shape of a gun and comprise a handle equipped with a motor activation trigger and a screwing/unscrewing shaft actuated by the motor. The latter is supplied with power by a rechargeable battery which slides reversibly into the handle. In the usage position, the battery is generally in a low position relative to the hand and constitutes the base of the screw-driving machine.

To this end, the object of the invention is a screw-driving machine support for a lifting tool comprising, with reference to the usage position:

- a telescopic mast comprising a fixed segment and a first telescopic segment mounted so as to slide inside the fixed segment;
- a geared mechanism for lifting the first sliding segment relative to the fixed segment, the lifting mechanism comprising a driving shaft with a rotation axis and a means for reversible fixing with a screwing/unscrewing shaft of a screw-driving machine;
- the screw-driving machine support comprising, with reference to the usage position:
  - a member for fixing to the mast;
  - a stop which is vertical, parallel and laterally offset relative to the rotation axis of the driving shaft;
  - a member for adjusting the position of the vertical stop relative to the rotation axis of the driving shaft.

According to other embodiments:

- the fixing member may comprise a longitudinal profile equipped, at a first end, with a means for fixing to the mast and, at a second end, with two lateral oblong slots; the adjustment member may comprise a sliding bracket straddling the fixing member and having a web on which the lateral stop is fixed, and two wings each comprising a round hole and an oblong slot arranged intersecting the oblong slots of the longitudinal profile; the sliding bracket being fixed adjustably to the fixing member by a first through bolt placed through the round holes of the sliding bracket and the oblong slots of the profile, and a second through bolt placed through the oblong slots of the sliding bracket and the oblong slots of the longitudinal profile;

the mast may comprise a rolling base (200), and the fixing member may be adapted for fixing to the rolling base of the mast;

the lateral stop may be fixed adjustably to the adjustment member;

the lateral stop may be fixed non-adjustably to the adjustment member;

the means for fixing the fixing member on the mast may comprise two parallel fixing plates which are secured to the fixing member and spaced apart from each other by a distance at least equal to a mast width, each plate comprising at least one hole facing the hole of the other plate, intended to receive a through bolt when the support is positioned on the mast;

the screw-driving machine support may also comprise a so-called transverse stop perpendicular to the lateral stop and to the rotation axis of the driving shaft, and intended in use to block a screw-driving machine handle transversely; and/or the screw-driving machine support may also comprise a so-called support surface perpendicular to the lateral stop and to the transverse stop so as to form a trihedral, and intended in use to support a screw-driving machine handle.

Another object of the invention is a lifting tool for lifting a construction plate, characterized in that it comprises:

a telescopic mast comprising a fixed segment and a first telescopic segment mounted so as to slide inside the fixed segment;

a mechanism for lifting, by gear or by winch, the first sliding segment relative to the fixed segment, the lifting mechanism comprising a driving shaft with a rotation axis, and a means for reversible fixing with a screwing/unscrewing shaft of a screw-driving machine;

a screw-driving machine support as described above.

A further object of the invention is a method for implementing a screw-driving machine support as described above, characterized in that it comprises the following steps:

(a) supplying a plate-lifting tool as described above;

(b) supplying a screw-driving machine and fixing it to the driving shaft of the lifting mechanism;

(c) supplying a screw-driving machine support as described above, and activating its fixing member to the mast of the tool;

(d) activating the adjustment member for the screw-driving machine support such that the lateral stop of the screw-driving machine support is in lateral contact with the screw-driving machine.

According to other embodiments:

step (d) may comprise the following sub-steps:

(d1) the bolts being loosened but engaged in the holes and slots of the sliding bracket and the profile, sliding the sliding bracket along the profile and inclining it such that the lateral stop of the screw-driving machine support is in lateral contact with the screw-driving machine;

(d2) tightening the bolts with nuts in order to hold the sliding bracket firmly on the profile;

and/or step (c) may comprise the following sub-steps:

(c1) placing the screw-driving machine support on the mast such that the two fixing plates of the support are arranged on either side of the mast;

(c2) placing a through bolt through the or each hole of a first fixing plate as far as an opposite hole of the other fixing plate, and tightening the bolts using a nut such that the fixing plates squeeze the mast by force.

Figure 2:
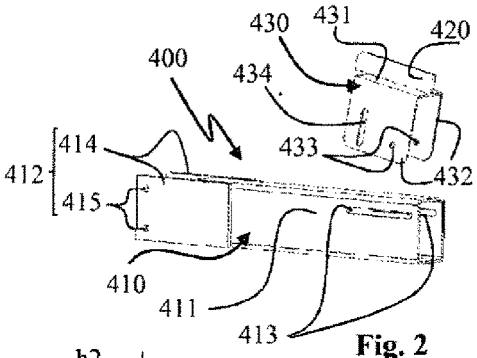
Figure 3:
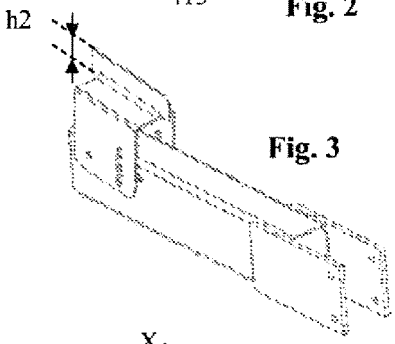
Figure 4:
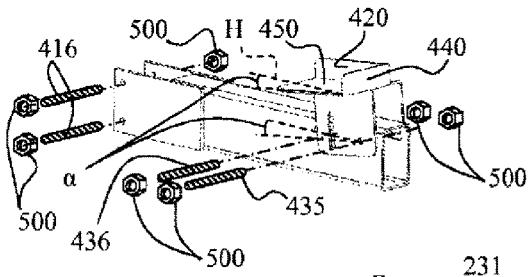
Figure 5:
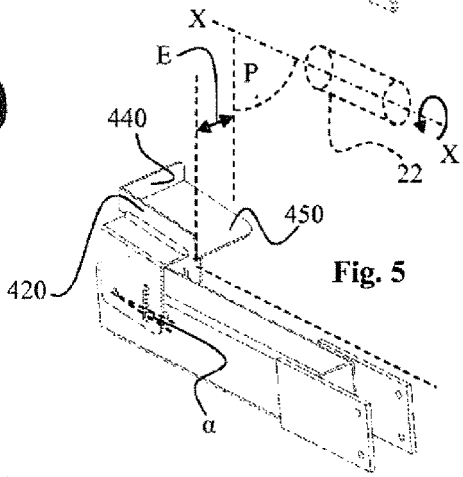
Figure 6:
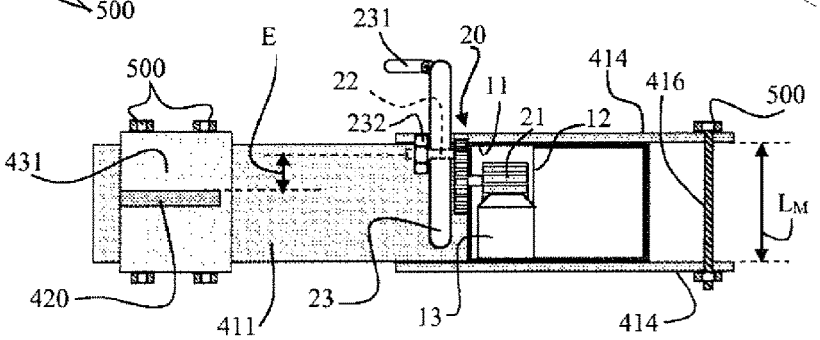

Further characteristics of the invention will be presented in the detailed description below, which is given with reference to the attached drawings showing respectively:

FIG. 1: a diagrammatic, perspective view of a plate-lift equipped with a screw-driving machine support according to the invention;

FIG. 2: a diagrammatic, perspective, partially exploded view of a first embodiment of a screw-driving machine support according to the invention;

FIG. 3: a diagrammatic, perspective view, from a different viewing angle, of the first embodiment of the screw-driving machine support in FIG. 2;

FIG. 4: a diagrammatic, perspective, partially exploded view of a second embodiment of a screw-driving machine support according to the invention;

FIG. 5: a diagrammatic, perspective view, from a different viewing angle, of the second embodiment of the screw-driving machine support in FIG. 2; and FIG. 6: a diagrammatic, section view from above of the plate-lift in FIG. 1, following a section line situated above the gear mechanism.

FIG. 1 illustrates a plate-lift in the usage position equipped with a geared lifting mechanism. The plate-lift 1 comprises a lifting mechanism 100 to which a rolling base 200 is fixed, and a plate support 300.

The lifting mechanism 100 comprises a telescopic mast 10 comprising a fixed segment 11 and a first telescopic segment 12 mounted so as to slide inside the fixed segment 11. A rack 13 is fixed to the first telescopic segment 11.

The rack 13 is in engagement with a gear system, illustrated in more detail in FIG. 6.

The gear system 20 comprises:

a pinion 21 in direct engagement with the rack 13, a driving shaft 22 fixed to a control wheel 23 and in indirect engagement with the pinion 21 via a demultiplication system 24, which is arranged such that the pinion 21 turns more quickly than the driving shaft 22. The driving shaft 22 passes through the wall of the fixed segment 11.

In order to facilitate the manual actuation of the lifting mechanism, the control wheel 23 may be equipped with a crank handle 231, preferably mounted pivotably on the control wheel.

The driving shaft passes through the wheel and at one end is equipped with an end piece 232 for fixing to a complementary end piece carried by a portable electric screw-driving machine. It is thus possible to actuate the lifting mechanism by a screw-driving machine, which limits the forces to be provided.

In a preferred embodiment which is particularly suitable for the use of a screw-driving machine, the demultiplication system 24 comprises:

a first pinion fixed to the driving shaft and with an internal radius (tooth base) of 13.5 mm, an external radius (tooth tip) of 18 mm, and 16 teeth;

a gear wheel in engagement with the first pinion and with an internal radius (tooth base) of 49.5 mm, an external radius (tooth tip) of 54 mm, and 52 teeth;

a second pinion, concentric and fixed to the gear wheel, in engagement with the rack 13 and with an internal radius (tooth base) of 13.5 mm, an external radius (tooth tip) of 18 mm, and 16 teeth.

This embodiment is particularly advantageous since it allows a great power transmission, such that neither a user in manual mode nor the screw-driving machine become fatigued, while ensuring a mast lifting speed which is higher than the speeds generally found with plate-lifts of the prior art.

In combination, according to a particularly interesting embodiment of the invention, the driving shaft 22 is fixed to the control wheel 23 via a unidirectional bearing. Thanks to this type of bearing, if the driving shaft 22 is engaged with a portable electric screw-driving machine, the driving shaft 22 may turn at high speed in the mast extension direction without causing the control wheel to rotate.

To ensure that the screw-driving machine does not rotate about itself when the user activates it, the invention provides an adaptable screw-driving machine support 400 on the plate-lift so as to block the rotation of the screw-driving machine, and the motor of the latter transmits all the rotational torque to the driving shaft of the lifting mechanism and not to the user's wrist.

According to the invention, the screw-driving machine support 400 generally comprises, with reference to the usage position:

- a member 410 for fixing to the mast 10;
- a so-called lateral stop 420 which is vertical, parallel and laterally offset relative to the rotation axis XX of the driving shaft 22 by a given distance E, and is intended in use to block a screw-driving machine handle (not shown) laterally;
- a member 430 for adjusting the position of the vertical stop 420 relative to the rotation axis XX of the driving shaft 22.

Thus, to implement the screw-driving machine support according to the invention, the user positions and fixes the screw-driving machine to the driving shaft of the lifting mechanism.

He then positions the screw-driving machine support according to the invention on the plate-lift, below the screw-driving machine, at a suitable height h1 relative to the axis XX determined by the user as a function of the plate-lift and the dimensions of its screw-driving machine, and activates the fixing member of the support on the plate-lift, preferably the mast.

Finally, he activates the adjustment member 430 of the screw-driving machine support such that the lateral stop 420 of the screw-driving machine support is in lateral contact with the screw-driving machine.

According to a preferred embodiment of the invention illustrated in FIGS. 1 to 6, the fixing member 410 comprises a longitudinal profile 411 equipped at a first end with a means 412 for fixing to the mast 10 and at a second end with two lateral oblong slots 413.

The fixing means 412 of the fixing member on the mast advantageously comprises two parallel fixing plates 414 fixed to the fixing member and spaced apart from each other by a distance at least equal to a mast width $L_M$.

Each plate comprises at least one hole 415 facing the hole 415 of the other plate and intended to receive a through bolt 416 when the support is positioned on the mast (see FIGS. 4 and 6).

When implementing a screw-driving machine support according to the invention, the user places the screw-driving machine support 400 on the mast such that the two fixing plates 414 of the support are arranged on either side of the mast.

He then places a through bolt 416 through the or each hole 415 of a first fixing plate as far as the opposite hole of the other fixing plate, and tightens the bolts using a nut 500 such that the fixing plates squeeze the mast by force.

The mast 10 advantageously comprises a rolling base 200. In an embodiment not shown, the means for fixing the screw-driving machine support may be adapted to attach to the rolling base of the mast. Alternatively, it may be designed to attach to the winch support when the lifting mechanism is a winch.

The embodiment illustrated in FIGS. 1 to 6 is given merely as an example and without limitation.

The fixing member may take multiple forms, and the fixing itself may be of different types depending on the design of the plate-lift.

The important factor is that the fixing member allows the screw-driving machine support to be held such that the lateral stop prevents the rotation of the screw-driving machine during use. In other words, the important factor is the lateral blocking of the screw-driving machine.

Thus, for example, the fixing to the mast may be rigid in a direction perpendicular to the rotation axis of the driving shaft of the lifting mechanism, and free in a direction parallel to the rotation axis of the driving shaft of the lifting mechanism.

According to the preferred embodiment of the invention shown in FIGS. 1 to 6, the adjustment member 430 comprises a sliding bracket straddling the fixing member 410 (FIG. 2 shows an exploded view for ease of understanding, and the sliding bracket is shown above the fixing member). The sliding bracket has a web 431 on which the lateral stop 420 is fixed, and two wings 432 each comprising a round hole 433 and an oblong slot 434 intersecting the oblong slots 413 of the fixing member.

The sliding bracket 430 is fixed adjustably to the fixing member 410 by a first through bolt 435 placed through the round holes 434 of the sliding bracket and the oblong slots 413 of the longitudinal profile 411, and a second through bolt 436 placed through the oblong slots 434 of the sliding bracket 430 and the oblong slots 413 of the longitudinal profile 411 (see FIG. 4).

Thanks to this arrangement, it is possible to adjust the axial distance (in the direction of axis XX) of the lateral stop 420 relative to the driving shaft, which allows adaptation to the dimensions of the screw-driving machine.

This also allows adjustment of angle $\alpha$ between the sliding bracket and the horizontal H.

Adjustment of the angle $\alpha$ of the sliding bracket is useful since most screw-driving machines have an angle between the surface of their base and the rotation axis of their screwing/unscrewing shaft. Thanks to this arrangement, the screw-driving machine support according to the invention has a degree of freedom and angular adjustment.

This function is particularly useful when the sliding bracket comprises a so-called transverse stop 440 perpendicular to the lateral stop 420 and to the rotation axis XX of the driving shaft 22, and intended in use to block the handle of the screw-driving machine transversely (see FIGS. 4 and 5).

This function is also useful when the sliding bracket comprises a support surface 431 sufficiently large to receive the screw-driving machine, in particular the base of its handle (usually the base of the battery).

Preferably, this support surface consists of a plate 450 of surface area larger than the web 431 of the sliding bracket, to allow support in use of the majority of the surface of the base of the screw-driving machine (see FIGS. 4 and 5).

This plate is fixed to the sliding bracket so as to be perpendicular to the lateral stop 420 and to the transverse stop 440, forming a trihedral which is particularly effective for blocking the screw-driving machine in the usage position.

During implementation of a screw-driving machine support according to the invention:

(d1) the user loosens the bolts 435 and 436 engaged in the holes 433 of the sliding bracket and the slots 434 of the sliding bracket and the slots 413 of the profile. He then slides the sliding bracket along the profile and inclines it such that the lateral stop 420, and where applicable the transverse stop 440 and the support surface 450 of the screw-driving machine support, are in contact with the handle of the screw-driving machine;

(d2) finally, the user tightens the bolts 435 and 436 with nuts 500 in order to hold the sliding bracket firmly on the profile.

In an embodiment (not shown) of a screw-driving machine support according to the invention, the lateral stop 420 is fixed adjustably to the adjustment member 430. In particular, it is adjustable in order to apply the lateral stop against the screw-driving machine in the usage position. For example, the trihedral formed by the lateral stop 420, the plate 450 and the transverse stop 440 is mounted adjustably on the sliding bracket in order to allow a lateral translation of the trihedral and application of the lateral stop 420 against the screw-driving machine.

In order to limit costs, it is possible to provide that the lateral stop is fixed non-adjustably on the adjustment member, for example by welding. In this case, the arrangement of the lateral stop 420 relative to the screw-driving machine support must be designed to allow the use of different screw-driving machines. In particular, the lateral dimensions of the screw-driving machines, in particular at the base of the handle at the level of the battery, must be taken into account. These dimensions define the distance E which is the distance separating the lateral stop 420 and a parallel plane P passing through the rotation axis XX of the driving shaft 22 of the lifting mechanism (see FIG. 5).

The distance E depends on the lateral dimension of the screw-driving machine used. The distance E is substantially equal to half the lateral dimension of the screw-driving machine at the bottom of the handle (generally, the battery location).

When the lateral stop 420 is mounted adjustably on the screw-driving machine support (embodiment not illustrated), it is sufficient to adjust the position of the distance of the lateral stop when the screw-driving machine is engaged with the driving shaft of the gear mechanism, such that the lateral stop is in contact with the handle of the screw-driving machine.

When the lateral stop 420 is mounted fixedly on the screw-driving machine support, it is sufficient, during production of the support according to the invention, to ensure that the majority of screw-driving machines can be blocked laterally in rotation during use, even if the screw-driving machine is not totally vertical in the blocked position. For this, the height h2 of the stop (see FIG. 3) must be at least 3 cm, preferably between 5 and 10 cm.

In practice, it has been found that a fixed distance E between 3.75 cm and 4.25 cm can serve the majority of screw-driving machines on the market.

Nonetheless, it is simple to design the screw-driving machine support by providing a greater distance and a set of shims (for example, magnetic), possibly of different widths, for adapting the distance, reducing it in order to use screw-driving machines with a small lateral dimension.

The invention claimed is:

1. A screw-driving machine support (400) for use with a plate-lifting tool, the plate-lifting tool comprising:

a telescopic mast (10) comprising a fixed segment (11) and a first telescopic segment (12) mounted so as to slide inside the fixed segment;

a mechanism (20) for lifting the first sliding segment relative to the fixed segment, the lifting mechanism comprising a driving shaft (22) with a rotation axis (XX) and a fixing means (232) for reversible fixing with a screwing/unscrewing shaft of a screw-driving machine;

the screw-driving machine support (400) comprising:

a fixing longitudinal member (410) intended to be fixed perpendicular to the mast (10) of the plate-lifting tool and parallel to the rotation axis (XX) of the driving shaft;

a support surface (431-450) to allow support in use of a base of a handle of the screw-driving machine;

a lateral stop (420) which is vertical, parallel and laterally offset relative to the rotation axis (XX) of the driving shaft by a given distance (E), and is intended in use to block the handle of the screw-driving machine laterally;

an adjustment member (430) for adjusting an axial distance of the lateral stop (420) in a direction of the rotation axis (XX) of the driving shaft (22).

2. The screw-driving machine support as claimed its claim 1, wherein:

the fixing member (410) comprises a longitudinal profile (411) equipped, at a first end, with a fixing means (412) for fixing to the mast and, at a second end, with two lateral oblong slots (413);

the adjustment member (430) comprises a sliding bracket straddling the fixing member and having a web (431) on which the lateral stop (420) is fixed, and two wings (432) each comprising a round hole (433) and an oblong slot (434) arranged intersecting the oblong slots (413) of the longitudinal profile (411);

the sliding bracket being fixed adjustably to the fixing member (410) by a first through bolt (435) placed through the round holes (433) of the sliding bracket and the oblong slots (413) of the profile, and a second through bolt (436) placed through the oblong slots (434) of the sliding bracket and the oblong slots (413) of the longitudinal profile (411).

3. The screw-driving machine support as claimed in claim 2, wherein the fixing means (412) for fixing the fixing member (410) on the mast comprise two parallel fixing plates (414) which are secured to the fixing member and spaced apart from each other by a distance at least equal to a mast width (LM), each plate (414) comprising at least one hole (415) facing the hole of the other plate, intended to receive a through bolt (416) when the support is positioned on the mast.

4. The screw-driving machine support as claimed in claim 1, wherein the lateral stop (420) is fixed adjustably to the adjustment member (430).

5. The screw-driving machine support as claimed in claim 1, wherein the lateral stop (420) is fixed non-adjustably to the adjustment member (430).

6. The screw-driving machine support as claimed in claim 1, also comprising a transverse stop (440) perpendicular to the lateral stop (420) and to the rotation axis (XX) of the driving shaft (22), and intended in use to block a screw-driving machine handle transversely.

7. The screw-driving machine support as claimed in claim 6, wherein the support surface (431, 450) is perpendicular to the lateral stop (420) and to the transverse stop (440), so as to form a trihedral, and intended in use to support a screw-driving machine handle.

8. A lifting tool for lifting a construction plate comprising:

a screw driving machine support as claimed in claim 1;

a driving shaft being equipped with an end piece (232) for reversible fixing to a complementary end piece carried by a screwing/unscrewing shaft of the screw-driving machine.

9. The screw-driving machine support as claimed in claim 8, wherein the mast comprises a rolling base (200) and the fixing member is adapted for fixing to the rolling base of the mast.

10. A method for implementing a screw-driving machine support comprising the following steps:

(a) supplying a plate-lifting tool as claimed in claim 8;

(b) supplying a screw-driving machine and fixing it to the driving shaft of the lifting mechanism;

(c) fixing the fixing member of the screw-driving machine support to the mast of the tool; and (d) moving the adjustment member for the screw-driving machine support, such that the lateral stop of the screw-driving machine support is in lateral contact with the screw-driving machine.

11. The method for implementing a screw-driving machine support as claimed in claim 10, wherein the fixing member (410) comprises a longitudinal profile (411) equipped, at a first end, with a means (412) for fixing to the mast and, at a second end, with two lateral oblong slots (413);

the adjustment member (430) comprises a sliding bracket straddling the fixing member and having a web (431) on which the lateral stop (420) is fixed and two wings (432) each comprising a round hole (433) and an oblong slot (434) arranged intersecting the oblong slots (413) of the longitudinal profile (411); the sliding bracket being fixed adjustably to the fixing member (410) by a first through bolt (435) placed through the round holes (433) of the sliding bracket and the oblong slots (413) of the profile, and a second through bolt (436) placed through the oblong slots (434) of the sliding bracket and the oblong slots (413) of the longitudinal profile (411) and further wherein step (d) comprises the following sub-steps:

(d1) the bolts being loosened but engaged in the holes and slots of the sliding bracket and the profile, sliding the sliding bracket along the profile and inclining it such that the lateral stop of the screw-driving machine support is in lateral contact with the screw-driving machine;

(d2) tightening the bolts with nuts in order to hold the sliding bracket firmly on the profile.

12. The method for implementing a screw-driving machine support as claimed in claim 10, wherein the fixing member (410) comprises a longitudinal profile (411) equipped, at a first end, with a means (412) for fixing to the mast and, at a second end, with two lateral oblong slots (413);

the adjustment member (430) comprises a sliding bracket straddling the fixing member and having a web (431) on which the lateral stop (420) is fixed, and two wings (432) each comprising a round hole (433) and an oblong slot (434) arranged intersecting the oblong slots (413) of the longitudinal profile (411); the sliding bracket being fixed adjustably to the fixing, member (410) by a first through bolt (435) placed through the round holes (433) of the sliding bracket and the oblong slots (413) of the profile, and a second through bolt (436) placed through the oblong slots (434) of the sliding bracket and the oblong slots (413) of the longitudinal profile (411) and the means (412) for fixing the fixing member (410) on the mast comprise two parallel fixing plates (414) which are secured to the fixing member and spaced apart from each other by a distance at least equal to a mast width (LM), each plate (414) comprising at least one hole (415) facing the hole of the other plate, intended to receive a through bolt (416) when the support is positioned on the mast and further wherein step (c) comprises the following sub-steps:

(c1) placing the screw-driving machine support on the mast such that the two fixing plates of the support are arranged on either side of the mast;

(c2) placing a through bolt through the or each hole of a first fixing plate as far as the opposite hole of the other fixing plate, and tightening the bolts using a nut such that the fixing plates squeeze the mast by force.

13. The screw driving machine support (400) of claim 1, wherein the adjustment member (430) is configured for adjusting the position of the lateral stop (420) along an axial distance in the direction of the rotation axis (XX) of the driving shaft (22), and for adjusting an angle (a) between the support surface (431) and the horizontal (H).

* * * * *